United States Patent [19]

Tomaro, deceased

[11] 4,295,283

[45] Oct. 20, 1981

[54] AIR DIFFUSER FOR A HAIR DRYER

[75] Inventor: Patrick M. Tomaro, deceased, late of Maplewood, N.J., by Rita Tomaro, executrix

[73] Assignee: Conair Corporation, Edison, N.J.

[21] Appl. No.: 161,073

[22] Filed: Jun. 19, 1980

Related U.S. Application Data

[63] Continuation of Ser. No. 40,886, May 21, 1979, abandoned.

[51] Int. Cl.[3] ..... A45D 20/12

[52] U.S. Cl. ..... 34/97; 219/373; 239/383

[58] Field of Search ..... 34/90, 96, 97, 98; 132/9; 239/101, 214, 222.17, 222.21, 381, 382, 383, 389, 463; 219/368, 373

[56] References Cited

U.S. PATENT DOCUMENTS

| | | | |
|---|---|---|---|
| 2,053,403 | 9/1936 | McCormick | 239/383 X |
| 2,624,559 | 1/1953 | Hyde . | |
| 2,817,000 | 12/1957 | Scheid | 34/96 X |
| 3,322,144 | 5/1967 | Boer, Jr. et al. | 34/98 |
| 3,599,345 | 8/1971 | Tolmie | 34/97 |
| 3,818,600 | 6/1974 | Fisher | 34/97 X |
| 3,835,869 | 9/1974 | Newman et al. | 34/97 X |
| 3,917,234 | 11/1975 | Brown, Jr. | 219/368 |
| 3,943,329 | 3/1976 | Hlavac | 34/96 X |
| 3,981,313 | 9/1976 | Burke et al. | 34/97 X |
| 3,990,460 | 11/1976 | Shalvoy | 132/9 |
| 4,097,722 | 6/1978 | Soler et al. | 219/373 X |
| 4,132,360 | 1/1979 | Lee, Jr. | 219/373 X |

*Primary Examiner*—Albert J. Makay
*Assistant Examiner*—Harold Joyce
*Attorney, Agent, or Firm*—Parmelee, Johnson, Bollinger & Bramblett

[57] ABSTRACT

A diffuser for a hair dryer reduces the force of impact of air discharged from the hair dryer against the hair of a user. The diffuser includes a housing having an inlet port, an outlet port and a freely rotatable fan blade mounted within the housing. The inlet port is removably interconnected to the discharge nozzle of a hair dryer so that air discharged from the hair dryer enters the housing, strikes the fan, and causes it to rotate. The rotating fan disperses the discharged air into a plurality of diversely directed eddy currents which flow out of the outlet port. These less powerful eddy currents, which are applied to the hair of a user, will not upset the setting of hair.

A screen can be interposed between the fan and the outlet port to prevent hair from becoming caught in the diffuser and to further disperse the eddy currents of air before they are discharged from the outlet port. Finger spacers can be mounted on the diffuser to keep the head of the user a predetermined distance away, and an adapter can be provided so that the size of the inlet port is adjustable to snugly receive different sized discharge nozzles of different hair dryers.

5 Claims, 7 Drawing Figures

Fig. 1.
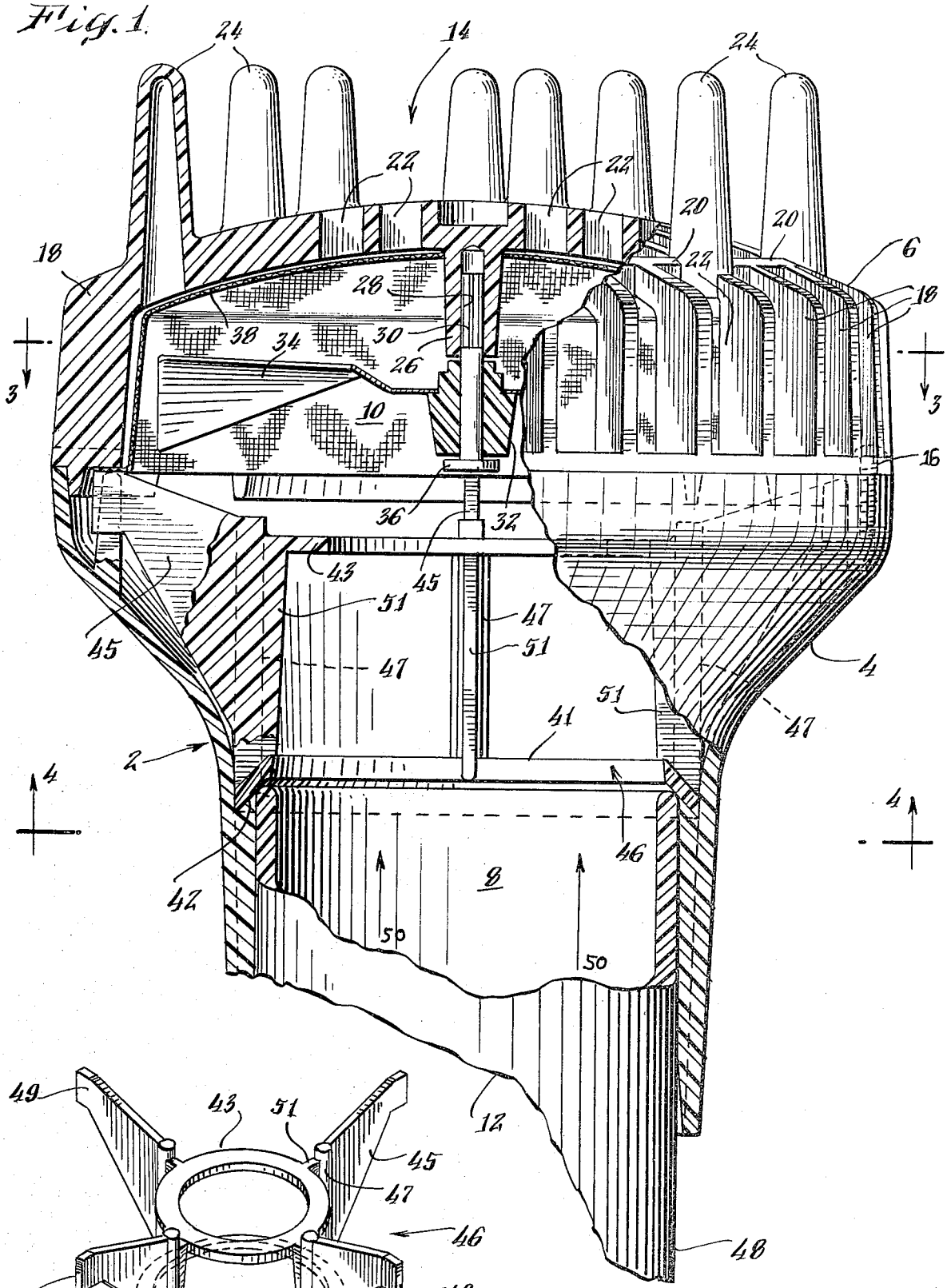
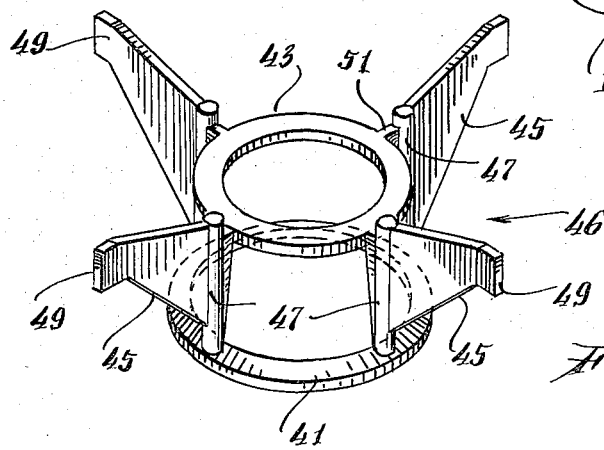
Fig. 1A.

AIR DIFFUSER FOR A HAIR DRYER

This is a continuation of application Ser. No. 040,886, filed May 21, 1979 abandoned.

BACKGROUND OF THE INVENTION

The present invention relates to accessories for hair dryers, and more particularly to an apparatus for diffusing the main stream of air discharged from a hair dryer into a plurality of smaller, less powerful, diversely directed eddy air currents.

Air diffusers used with hair dryers are known in the art and have become popular with the current fashion trend of wearing one's hair set in small curls. Such curls cannot withstand the force of impact of a powerful stream of air discharged from a hair dryer because direct application of this air to the hair causes the curls to straighten and disturbs their setting.

To avoid such adverse effects, air diffusers have been attached to the discharge outlets of hair dryers to dissipate the powerful main stream of discharged air. These known diffusers have a power driven fan and means for driving the fan. The spinning fan dissipates the main stream of air from the dryer into a plurality of smaller eddy currents by dispersing and rapidly changing the angle of flow of the discharged air. The force of the initial stream of discharged air is thus dissipated, and the plurality of less powerful eddy currents are applied to the hair of a user.

However, because the known diffusers are power driven they require separate motors and separate sources of electrical power for driving the motors, and accordingly, are expensive.

The present invention provides an economical diffuser having a freely rotatable fan blade which is driven only by air discharged from a hair dryer. Consequently, the disclosed diffuser does not need a separate motor or energy source to rotate the fan, and accordingly, is convenient to use and relatively inexpensive to produce.

SUMMARY OF THE INVENTION

The present invention provides an air diffuser attachment for a hair dryer which dissipates a powerful main stream of air discharged from a hair dryer into a plurality of less powerful, diversely directed eddy currents. These eddy currents, which are gently applied to the hair, will not disturb its setting.

The diffuser includes a housing having an air inlet port on its first end and an outlet port on its second end. The first end of the diffuser can be removably connected with the discharge outlet of a hair dryer so that air discharged from the hair dryer enters the inlet port, flows through the housing, and is discharged from the diffuser through the outlet port.

A freely rotatable fan is mounted within the housing and positioned such that it is in the path of air flowing through the housing. The force of the air discharged from the hair dryer strikes the fan and causes it to rotate. The rotating fan dissipates and deflects the stream of discharged air into a plurality of less powerful, diversely directed eddy currents of air which are discharged from the diffuser through its outlet port.

A screen can be interposed between the rotatable fan and the discharge port to further deflect and dissipate the eddy currents before they are discharged from the housing. The screen also prevents the hair of a user from becoming caught in the fan. Outwardly extending finger spacers may be mounted on the diffuser to assure that the head of a user is kept at least a predetermined distance away from the housing.

An adapter can be used to selectively adjust the size of the air inlet port of the diffuser to provide a snug interfit with different sized hair dryer discharge nozzles. Accordingly, the diffuser can be used interchangeably with different types of hair dryers.

BRIEF DESCRIPTION OF THE DRAWINGS

FIG. 1 illustrates a cross-sectional elevational view of one embodiment of a diffuser in accordance with the present invention;

FIG. 1A is a perspective view of an adapter used in the diffuser to vary the size of the inlet port of the diffuser;

DESCRIPTION OF THE PREFERRED EMBODIMENT

Figure 2:
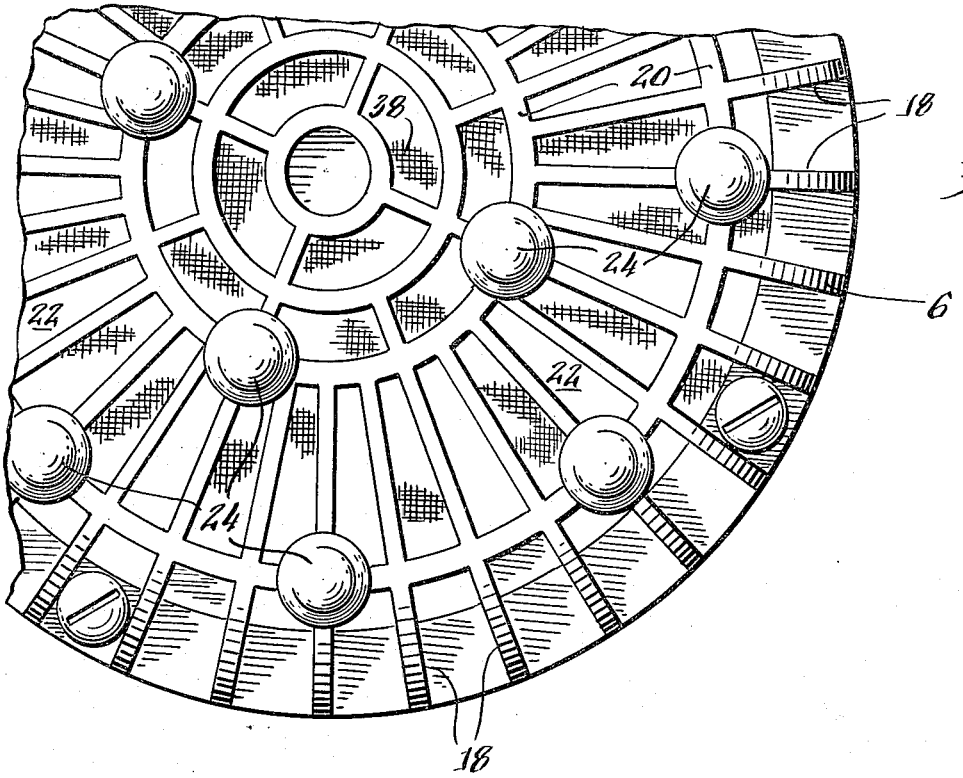
FIG. 2 is a top plan view of the diffuser of FIG. 1.
Figure 3:
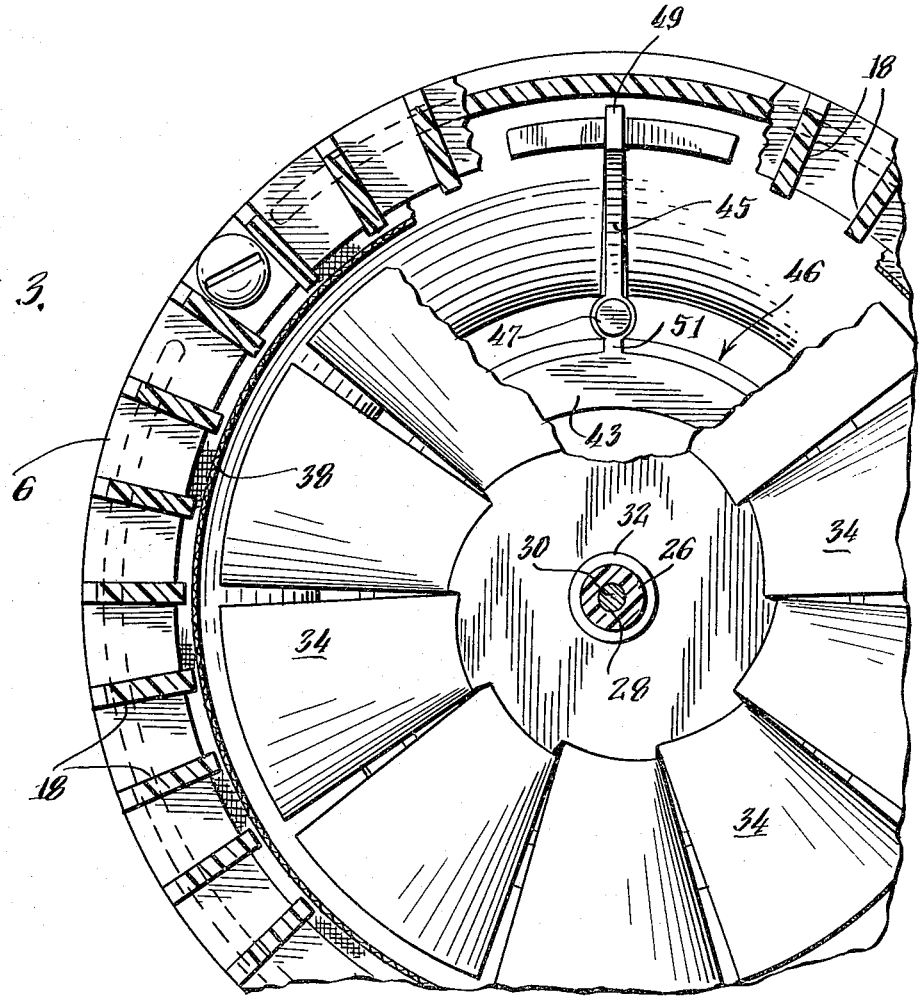
FIG. 3 is a plan view of the diffuser taken along lines 3—3 of FIG. 1.
Figure 4:
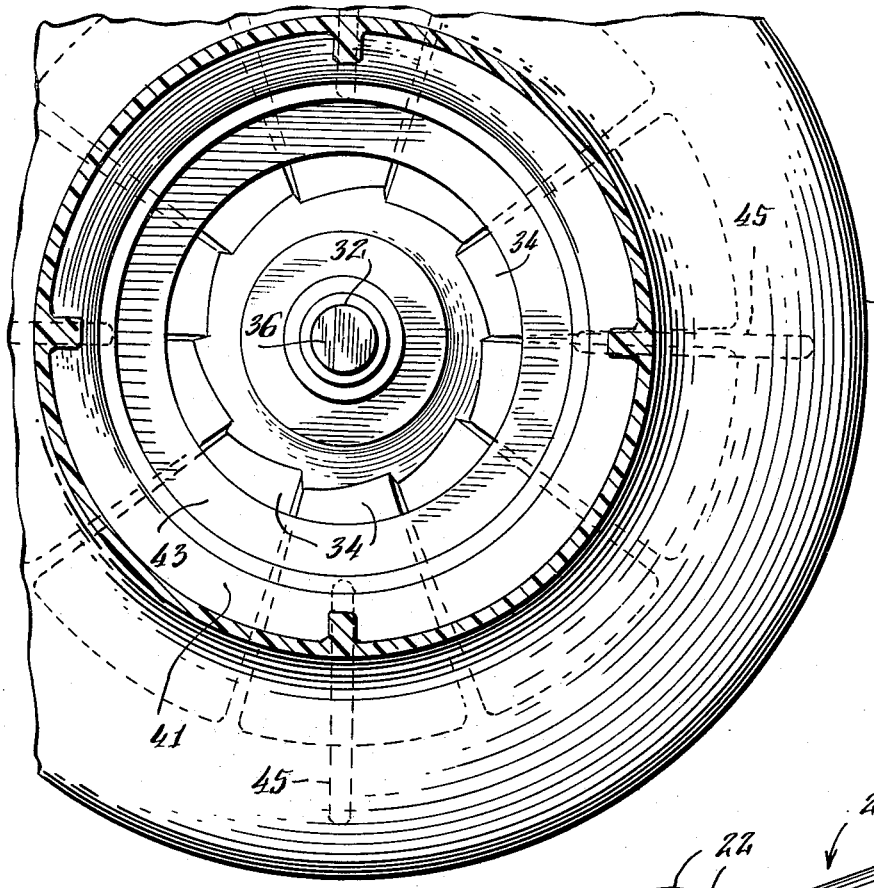
FIG. 4 is a plan view of the diffuser taken along lines 4—4 of FIG. 1.
Figure 5:
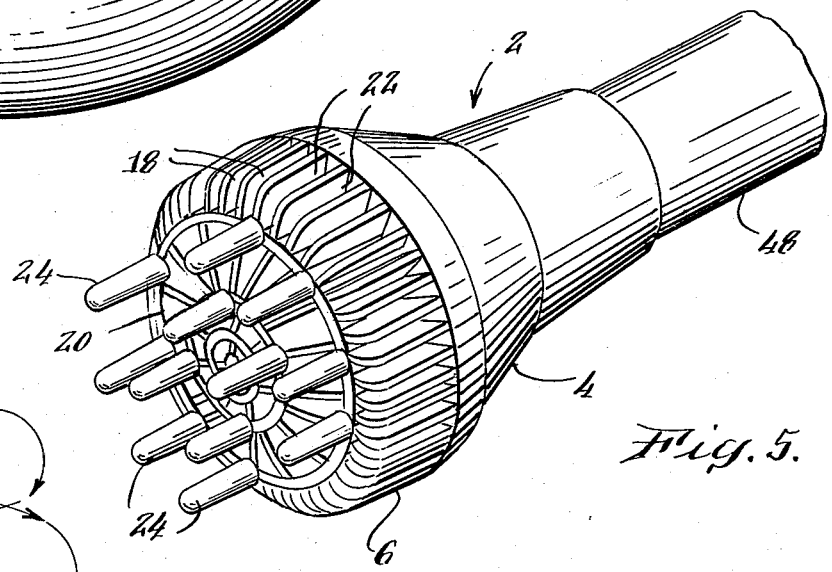
FIG. 5 is a perspective view of the diffuser of FIG. 1 attached to the discharge outlet of a hair dryer.

The present invention provides a diffuser attachment for a hair dryer which is useful to reduce the force of impact of discharged air against the hair of a user. The diffuser, which can be removably interconnected with the discharge nozzle of a hair dryer, has a freely rotatable fan blade driven only by the force of air discharged from the hair dryer. The rotating fan blade dissipates and deflects the main stream of air discharged from the hair dryer into a plurality of less powerful, diversely directed, eddy currents. The diffuser may also include a screen to further dissipate these eddy currents, and finger spacers to keep the head of a user a predetermined distance away from the housing. Because no driving means are required to rotate the fan blade, the diffuser is compact, can be produced at a reasonable cost, and is less likely to require maintenance or servicing as compared to a power driven device.

FIGS. 1–6 of the drawing illustrate a preferred embodiment of the diffuser in accordance with the present invention. A housing 2, which includes a lower housing portion 4 and a cover 6 removably mounted to the upper end of the lower housing portion, defines an air inlet chamber 8 and a wider air outlet chamber 10. The inlet chamber terminates at an air inlet port 12 defined at one end of the housing, and the outlet chamber terminates at an air outlet port, shown generally by the numeral 14, defined at the other end of the housing. The outlet port is larger than the inlet port. Inlet and outlet chambers 8 and 10 define a passageway within the housing such that air introduced at the inlet port flows through the inlet and outlet chambers and is discharged from the housing through the air outlet port. As seen best in FIG. 1, the cover 6, which defines a portion of the air outlet chamber 10, is removably fixed to the top of the lower housing portion 4 by conventional means, as, for example, screws 16.

As best seen in FIG. 2, the cover 6 includes a series of ribs 18 extending in a generally radial direction, and circular cross members 20 which intersect the ribs at approximately right angles. The ribs and cross members define a plurality of slits 22, which provide a passageway for air flowing through the cover. These slits comprise the outlet port which is generally shown by numeral 14 at the upper end of the housing in FIG. 1.

The cover 6 also includes a plurality of elongated finger spacers 24 extending outwardly from the cover's outer surface. The bottoms of these spacers are mounted to the cover at the points of intersection of the ribs 18 and cross members 20. These spacers prevent the head of a user of the diffuser from coming too close to the housing.

A projection 26 is mounted to the approximate center of the inner surface of the cover 6. This projection extends into the outlet chamber 10 of the housing 2 when the cover is mounted in position on the lower housing 4. A bore 28 is defined within the projection 26, and the upper end of a shaft 30 is mounted co-axially in the bore.

A fan assembly, including a central hub 32 and a plurality of fan blades 34, is rotatably mounted to the shaft 30. The fan assembly is held on the shaft by conventional means, as for example, a pin 36 or a nut (not shown) affixed to the shaft below the hub 32. The fan blades 34 extend radially outward from the hub towards the inner sidewall of the cover 6, and are slightly shorter than the inner radius of that cover. In this manner, the fan blades extend throughout substantially the entire cross sectional area of the outlet chamber 10, but the sidewalls of the cover will not interfere with the spinning motion of the blades.

A screen 38 is mounted within the housing and downstream from the fan assembly in such position that it covers the air outlet port 14 of the housing. As previously discussed, the air outlet port comprises the plurality of slits 22 on the cover 6. As seen in FIG. 1, the screen is mounted by wedging its outer periphery between the bottom of the cover 6 and the upper portions of legs 45 on an adapter 46, to be discussed below. Because the screen covers the outlet port, all air passing by the fan must pass through the screen before it leaves the diffuser through the outlet port.

Although not shown in FIG. 1, the screen alternately can be mounted directly to the inner surface of the cover 6. Furthermore, since the only requirement regarding the position of the screen is that it be placed so that air passing the fan assembly must flow through the screen before being applied to the hair of a user, the screen can also be mounted to the outer surface of the cover 6.

An adapter 46, which is best shown in FIGS. 1 and 1A, is mounted within the lower portion 4 of the housing. The adapter, which can be formed from plastic, has a lower ring 41 which is joined to a smaller upper ring 43 by a plurality of upwardly extending posts 47. Each of the posts 47 has an inwardly directed, elongated triangular member 51, which supports the smaller upper ring and is sufficiently wide at its upper end to compensate for the difference in size between the upper and lower rings. Additionally, each post has an outwardly directed leg 45 including a squared end portion 49.

As best disclosed in FIG. 1, the adapter 46 is mounted within the lower housing of the diffuser by seating the lower ring 41 in an annular groove 42 defined on the inner surface of the housing within the narrow necked inlet chamber 8. As noted before, when the adapter is seated in the annular groove, the end portions 49 of the legs 45 are positioned to sandwich the periphery of the screen 38 between the upper surface of the end portions and the bottom of the cover 6.

The adapter 46 is removably seated in the annular groove 42 to vary the width of the size of the inlet chamber 8 to accommodate hair dryers having discharge nozzles of different sizes. By matching the size of the upper ring 43 of the adapter with the circumference of a discharge nozzle of a hair dryer 48, the nozzle of the hair dryer will be snugly secured within the space of the inner ring to securely mount the diffuser to the discharge nozzle of the dryer. Subsequently, if a hair dryer having a different size outlet nozzle is to be used with the diffuser, the adapter 46 is removed from the diffuser and replaced with another adapter having an upper ring of a size which accommodates the new hair dryer. By interchanging the adapters, a single diffuser can be used with different hair dryers. The lower ring 41 of different adapters should preferably be the same size because the size of the annular groove 42 is constant.

In operation, the discharge nozzle of a hair dryer 48 is inserted through air inlet port 12 and into the inlet chamber 8, and a powerful stream of discharged air is introduced into the housing 2. Air flow into the housing is indicated by the arrows 50 of FIGS. 1 and 6.

Figure 6:
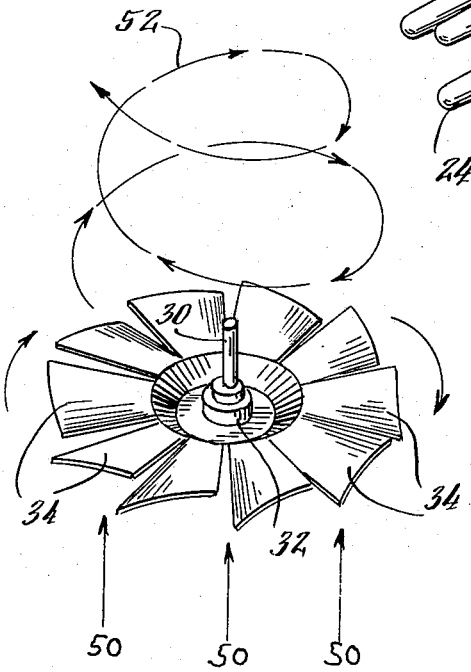
FIG. 6 shows a fan assembly used with the diffuser.

The main stream of discharged air strikes the fan blades 34, which as seen from FIGS. 6, are sloped and angled so that the impinging air causes them to rotate. Because the fan assembly is centered and the fan blades extend throughout substantially the entire cross section area of the housing, the discharged air cannot avoid striking the fan blades. Also, as illustrated by FIG. 6, the fan blades 34 can be symmetrically arranged around the central hub 32.

The spinning fan blades dissipate and deflect the powerful main stream of discharged air into a plurality of less powerful, diversely directed, eddy currents, shown by arrows 52 in FIG. 6.

The screen 38, which is affixed to the periphery of the cover 6 and is interposed between the fan blades 34 and the cover 6, covers the air outlet port 14. After the main stream of discharged air has been dissipated into a plurality of eddy currents by the spinning fan, these less powerful air currents must pass through the screen before they are discharged from the diffuser through the outlet port which is defined by the slits 22 on the cover 6. Consequently, the screen further disperses and deflects the already dissipated eddy air currents before they are applied to the hair of a user.

The screen also assures safe operation of the diffuser because it keeps the user's hair or fingers out of the housing and away from the spinning fan.

Once the eddy currents have passed through the screen, they leave the diffuser through the elongated open slits 22 of the cover 6. The diffuser has dissipated the initial powerful main stream of discharged air from the hair dryer into a plurality of smaller, less powerful currents which can be applied to the hair of a user without upsetting or destroying the setting of curls. As already mentioned, the outlet port of the housing is larger than the inlet port. Accordingly, the total surface area of the plurality of elongated slits 22 is greater than the area of the inlet port. Such a construction further aids in dispersing the air discharged from the outlet over a wide range outside of the diffuser, thus further weakening the impact of the discharged air.

FIG. 1 also shows the plurality of elongated finger spacers 24 extending upwardly from the top of the cover 6. These finger spacers assure that the head of a user cannot get closer than a predetermined distance to the outlet port so that the diffuser will be used safely.

The diffuser described herein does not require a motor to drive the fan or an electrical power source to energize the motor because the fan is a freely rotating fan and is driven only by the force of the air discharged from the hair dryer itself. Thus the disclosed diffuser is economical. Furthermore, it is smaller and weighs less than a power driven device because it does not have to be of sufficient size to accommodate a motor or power source. Because the disclosed diffuser has less operable components than a power driven diffuser, it is less likely to require maintenance or repairs than a power driven model.

As previously discussed, the fan assembly of the preferred embodiment of the diffuser is mounted to the inner surface of the top of the removable cover 6. In this way, easy access to the fan assembly for inspection and maintenance is provided by merely removing the cover from the housing. Because the screen of the diffuser is mounted to the housing just below the cover, removal of the cover also provides easy access to the screen for inspection and maintenance purposes.

Although the axis of rotation of the fan is shown as being in a plane perpendicular to the flow of air from an attached hair dryer, it can also be angled. The only requirement of the position of the fan is that it be mounted so that it is in the path of the main stream of air discharged from the hair dryer. Although the housing in the preferred embodiment comprises a housing having a lower housing portion and a cover removably mounted thereon, the invention can also be practiced with a unitary housing utilizing the concept of the freely rotatable fan blade as discussed herein. Furthermore, although the air outlet port of the preferred embodiment is formed from a plurality of slits on the removable cover, a single opening can also be used as the outlet port.

It is believed that other modifications and variations of the above described invention will be apparent to those skilled in the art. Accordingly, the description herein is intended to be illustrative only, and not restrictive of the scope of the invention, that scope being defined by the following claims and all equivalents thereto.

What is claimed is:

1. A diffuser attachment for a hand-held hair dryer for dissipating and reducing the force of an air stream of a hair dryer, said diffuser including:

a housing having an air inlet opening at a first end and an air outlet opening at a second end in alignment with said air inlet opening such that air introduced into said air inlet opening flows through said housing and is discharged therefrom through said air outlet opening, said air outlet opening being larger than said air inlet opening, said first end of said housing being adapted to be removably interconnectable with an air discharge outlet of a hair dryer, a freely rotatable fan rotatably mounted within said housing between said air inlet opening and said air outlet opening having a plurality of fan blades arranged symmetrically about a central hub, said fan blades extending substantially throughout the entire cross sectional area of said housing, said blades of said fan being so positioned such that substantially all the air discharged from said hair dryer into said air inlet opening strikes said fan and causes it to rotate, whereby said rotatable fan disperses and deflects substantially all air discharged from said hair dryer into a plurality of diversely directed, less powerful eddy air currents, which are discharged from said housing through said air outlet opening.

2. A diffuser as claimed in claim 1 wherein said first end of said housing defines a narrow neck chamber for insertably receiving therein said air discharge outlet of said hair dryer.

3. A diffuser as claimed in claim 1 further including means for selectively adjusting the size of said air inlet opening for selectively receiving air discharge outlets of different sized hair dryers.

4. A diffuser as claimed in claim 3 wherein said means for selectively adjusting the size includes an adapter having a first ring adapted to being removably seated within an annular groove defined on the inner surface of said housing towards said first end thereof, and a second ring mounted above said first ring, said second ring being smaller than said first ring and being adapted to snugly receive the air outlet nozzle of a correspondingly sized hair dryer.

5. A diffuser as set forth in claim 1 wherein said second end of said housing is formed from a porous cover which is removably mounted to the remainder of said housing, the pores of said porous cover defining said air outlet opening at said second end, means extending from the upper surface thereof for maintaining said second end of said housing a predetermined distance from the body of the user, said fan being rotatably mounted to said porous cover which covers said larger air outlet opening of said housing when said porous cover is mounted thereon.

* * * * *